US009592974B2

(12) United States Patent
Saito et al.

(10) Patent No.: US 9,592,974 B2
(45) Date of Patent: Mar. 14, 2017

(54) SHEET FEEDER

(71) Applicant: BROTHER KOGYO KABUSHIKI KAISHA, Nagoya-shi, Aichi-ken (JP)

(72) Inventors: Yutaka Saito, Kasugai (JP); Masatsugu Mizuno, Kuwana (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/857,490

(22) Filed: Sep. 17, 2015

(65) Prior Publication Data

US 2016/0090250 A1 Mar. 31, 2016

(30) Foreign Application Priority Data

Sep. 30, 2014 (JP) ..... 2014-201111

(51) Int. Cl.

| | |
|---|---|
| ***B65H 3/34*** | (2006.01) |
| ***B65H 3/06*** | (2006.01) |
| ***B65H 3/56*** | (2006.01) |
| ***B65H 3/66*** | (2006.01) |

(52) U.S. Cl.

CPC ..... *B65H 3/0669* (2013.01); *B65H 3/063* (2013.01); *B65H 3/34* (2013.01); *B65H 3/56* (2013.01); *B65H 3/66* (2013.01); *B65H 2404/63* (2013.01); *B65H 2404/64* (2013.01); *B65H 2801/39* (2013.01)

(58) Field of Classification Search

CPC ... B65H 3/34; B65H 3/54; B65H 3/56; B65H 3/565; B65H 3/063

See application file for complete search history.

(56) References Cited

U.S. PATENT DOCUMENTS

| | | | | |
|---|---|---|---|---|
| 5,052,676 | A * | 10/1991 | Shiina | B65H 3/5238 271/121 |
| 5,316,285 | A | 5/1994 | Olson et al. | |
| 7,357,386 | B2 * | 4/2008 | Shikan | B65H 1/24 271/10.09 |

(Continued)

FOREIGN PATENT DOCUMENTS

| | | | |
|---|---|---|---|
| EP | 1 604 926 | A1 | 12/2005 |
| JP | 2004-269231 | A | 9/2004 |
| JP | 2008-207944 | A | 9/2008 |

OTHER PUBLICATIONS

Extended European Search Report for corresponding European Patent Application No. 15186155.6 mailed Mar. 2, 2016.

*Primary Examiner* — Jeremy R Severson

(74) *Attorney, Agent, or Firm* — Merchant & Gould P.C.

(57) ABSTRACT

A sheet feeder including a driving mechanism moving a stopper, an end of the stopper in a first position being closer to a pickup roller axis than a part of a roller surface of a pickup roller, the end of the stopper in a second position being farther from the pickup roller axis than the part of the roller surface, and a movable set guide having a first surface facing in a particular direction to become farther from the roller surface, the first surface being farther from the pickup roller axis than all the roller surface when the set guide is in a third position and contacts the stopper in the first position, the first surface being closer to the pickup roller axis than the part of the roller surface when the set guide is in a fourth position and separated away from the stopper in the second position.

15 Claims, 6 Drawing Sheets

(56) References Cited

U.S. PATENT DOCUMENTS

| | | | | |
|---|---|---|---|---|
| 7,407,158 | B2 * | 8/2008 | Ogaya | B65H 3/0638 271/119 |
| 7,410,161 | B2 * | 8/2008 | Yamamoto | B65H 3/063 271/113 |
| 7,543,811 | B2 * | 6/2009 | Shimamura | B65H 3/56 271/117 |
| 7,621,522 | B2 * | 11/2009 | Yasukawa | B65H 3/063 271/114 |
| 9,114,947 | B2 * | 8/2015 | Okumura | B65H 3/0653 |
| 2006/0097441 | A1 | 5/2006 | Shikan et al. | |
| 2008/0203652 | A1 | 8/2008 | Yasukawa et al. | |
| 2010/0044954 | A1 * | 2/2010 | Kobayashi | B65H 3/0661 271/117 |
| 2014/0061998 | A1 | 3/2014 | Kasashima et al. | |

* cited by examiner

SHEET FEEDER

CROSS-REFERENCE TO RELATED APPLICATION

This application claims priority under 35 U.S.C. §119 from Japanese Patent Application No. 2014-201111 filed on Sep. 30, 2014. The entire subject matter of the application is incorporated herein by reference.

BACKGROUND

Technical Field

The following description relates to one or more techniques for a sheet feeder.

Related Art

A sheet feeder has been known that includes a flap configured to swing between a standby position and a sheet feeding position. When the flap is in the standby position, sheet feeding in a sheet feeding direction is forbidden. Meanwhile, when the flap is in the sheet feeding position, sheet feeding in the sheet feeding direction is permitted. By a flap spring, the flap is urged toward the standby position from sheet feeding position. In the sheet feeding, the flap is pushed by a sheet being fed by a set roller, and is swung from the standby position to the sheet feeding position.

SUMMARY

According to aspects of the present disclosure, a sheet feeder is provided, which includes a housing, a supporter attached to the housing, the supporter having a particular surface, a pickup roller rotatable around a pickup roller axis, a part of a surface of the pickup roller being exposed from the particular surface, a stopper movable between a first position and a second position, a distal end of the stopper being configured to, when the stopper is in the first position, be closer to the pickup roller axis than the part of the surface of the pickup roller, the distal end of the stopper being further configured to, when the stopper is in the second position, be farther from the pickup roller axis than the part of the surface of the pickup roller, a driving mechanism configured to move the stopper between the first position and the second position, the driving mechanism including a motor, and a set guide movable between a third position and a fourth position, the set guide having a first surface that faces in a particular direction such as to become farther away from the part of the surface of the pickup roller, the first surface being configured to, when the set guide is in the third position and in contact with the stopper in the first position, be farther from the pickup roller axis than all the surface of the pickup roller, the first surface being further configured to, when the set guide is in the fourth position and separated away from the stopper in the second position, be closer to the pickup roller axis than the part of the surface of the pickup roller.

According to aspects of the present disclosure, further provided is a sheet feeder that includes a feed tray configured to support a sheet placed thereon, a pickup roller configured to rotate around a pickup roller axis and feed the sheet placed on the feed tray in a sheet feeding direction, a stopper movable between a restriction position where the stopper restricts the sheet from being fed downstream in the sheet feeding direction by the pickup roller and a permission position where the stopper permits the sheet to be fed downstream in the sheet feeding direction by the pickup roller, a driving mechanism configured to move the stopper between the restriction position and the permission position, the driving mechanism including a motor, and a set guide movable between a contact position to allow the pickup roller to contact the sheet placed on the feed tray, and a non-contact position to prevent the pickup roller to contact the sheet placed on the feed tray, the set guide being configured to, in response to the stopper being placed in the restriction position by the driving mechanism, come into contact with the stopper and move to the non-contact position, the set guide being further configured to, in response to the stopper being placed in the permission position by the driving mechanism, be separated away from the stopper and move to the non-contact position.

According to aspects of the present disclosure, further provided is a sheet feeder that includes a feed tray configured to support a sheet placed thereon, a pickup roller configured to rotate around a pickup roller axis and feed the sheet placed on the feed tray in a sheet feeding direction along a conveyance path, a stopper movable between a restriction position where the stopper interrupts the conveyance path and a permission position where the stopper does not interrupt the conveyance path, a driving mechanism configured to move the stopper between the restriction position and the permission position, the driving mechanism including a motor, and a set guide having a first surface facing in a particular direction such as to become farther away from a surface of the pickup roller, the set guide being movable between a third position where the first surface is positioned downstream of all the surface of the pickup roller in the particular direction and a fourth position where the first surface is positioned upstream of at least a part of the surface of the pickup roller in the particular direction, wherein in response to the stopper being placed in the restriction position by the driving mechanism, the stopper comes into contact with the set guide, and the set guide is placed in the third position, and in response to the stopper being placed in the permission position by the driving mechanism, the stopper is separated away from the set guide, and the set guide is placed in the fourth position.

BRIEF DESCRIPTION OF THE ACCOMPANYING DRAWINGS

Figure 4:
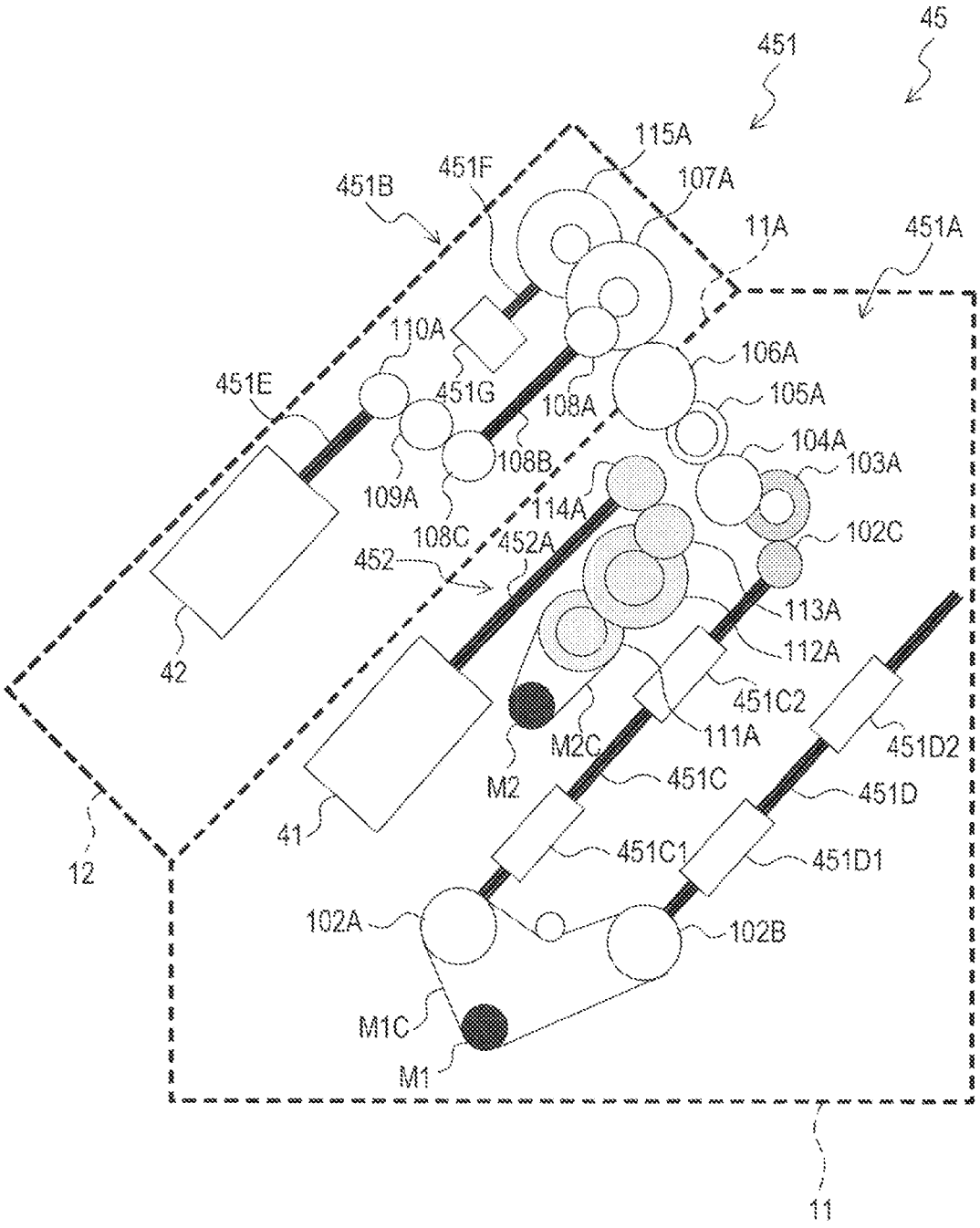

FIG. 4 schematically shows a sheet conveyance mechanism and a power transmission mechanism therefor, in accordance with one or more aspects of the present disclosure.

Figure 5A:
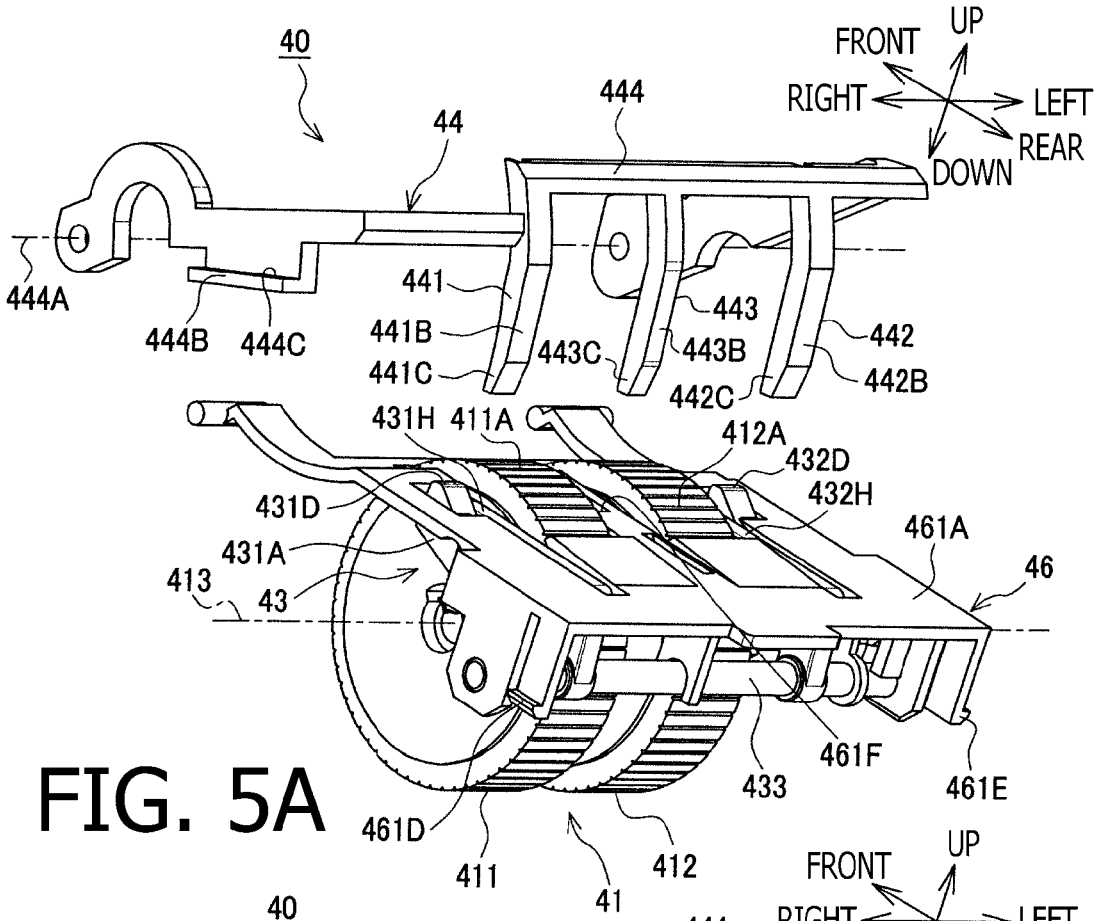

FIG. 5A is a perspective view showing the sheet feeding mechanism of the image reader in a state where the stopper is in a second position, and the set guide is in a fourth position, in accordance with one or more aspects of the present disclosure.

Figure 5B:
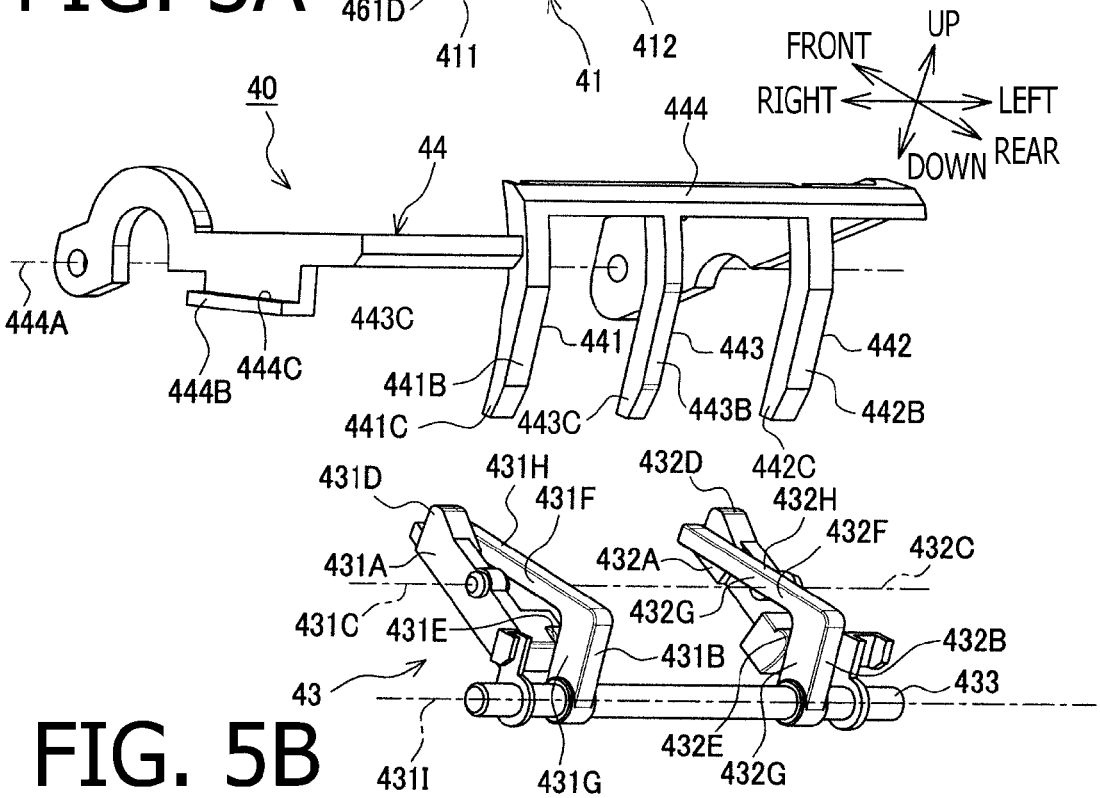

FIG. 5B is a perspective view showing the sheet feeding mechanism from which one or more components are removed, in the state where the stopper is in the second position, and the set guide is in the fourth position, in accordance with one or more aspects of the present disclosure.

Figure 6A:
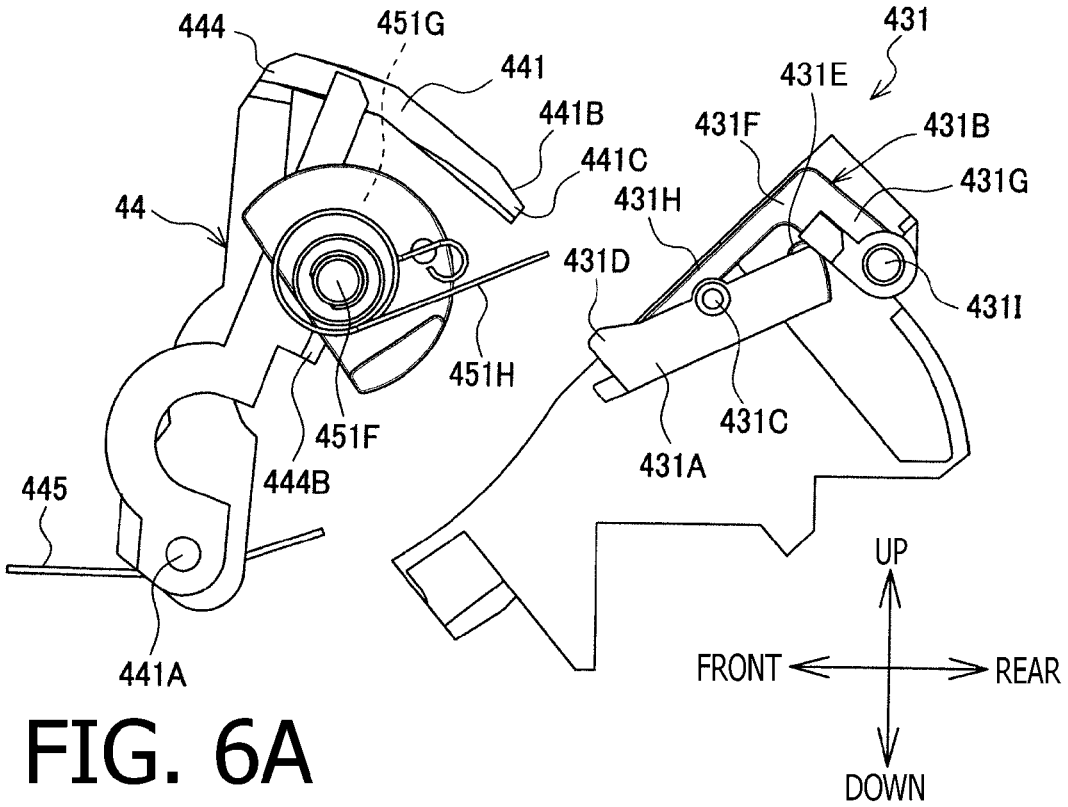

FIG. 6A is a side view showing the sheet feeding mechanism of the image reader in the state where the stopper is in the second position, and the set guide is in the fourth position, in accordance with one or more aspects of the present disclosure.

Figure 6B:
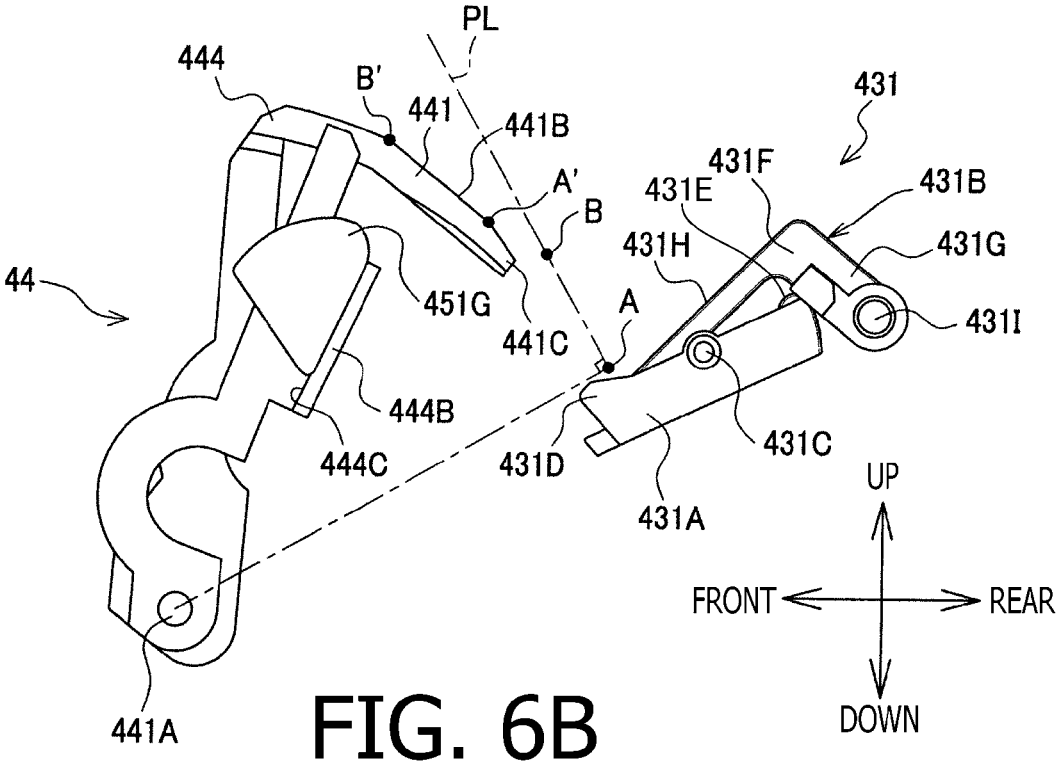

FIG. 6B is a side view showing the sheet feeding mechanism from which one or more components are removed, in the state where the stopper is in the second position, and the set guide is in the fourth position, in accordance with one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect.

According to the known sheet feeder, in the sheet feeding, the flap is pushed by a sheet being fed by the set roller, and is swung from the standby position to the sheet feeding position. The sheet, which is being fed, receives from the flap a reaction force in a direction opposite to the sheet feeding direction. By the reaction force, the sheet might be deformed (e.g., the sheet might be bent). In particular, when a leading end of the sheet being fed in the sheet feeding direction is curled, the sheet is more likely to be deformed.

Aspects of the present disclosure are advantageous to provide one or more improved techniques that make it possible to prevent a sheet from being deformed when fed by a sheet feeder.

Hereinafter, an illustrative embodiment according to aspects of the present disclosure will be described with reference to the accompanying drawings.

[1. Configuration of Image Reader]

Figure 1:
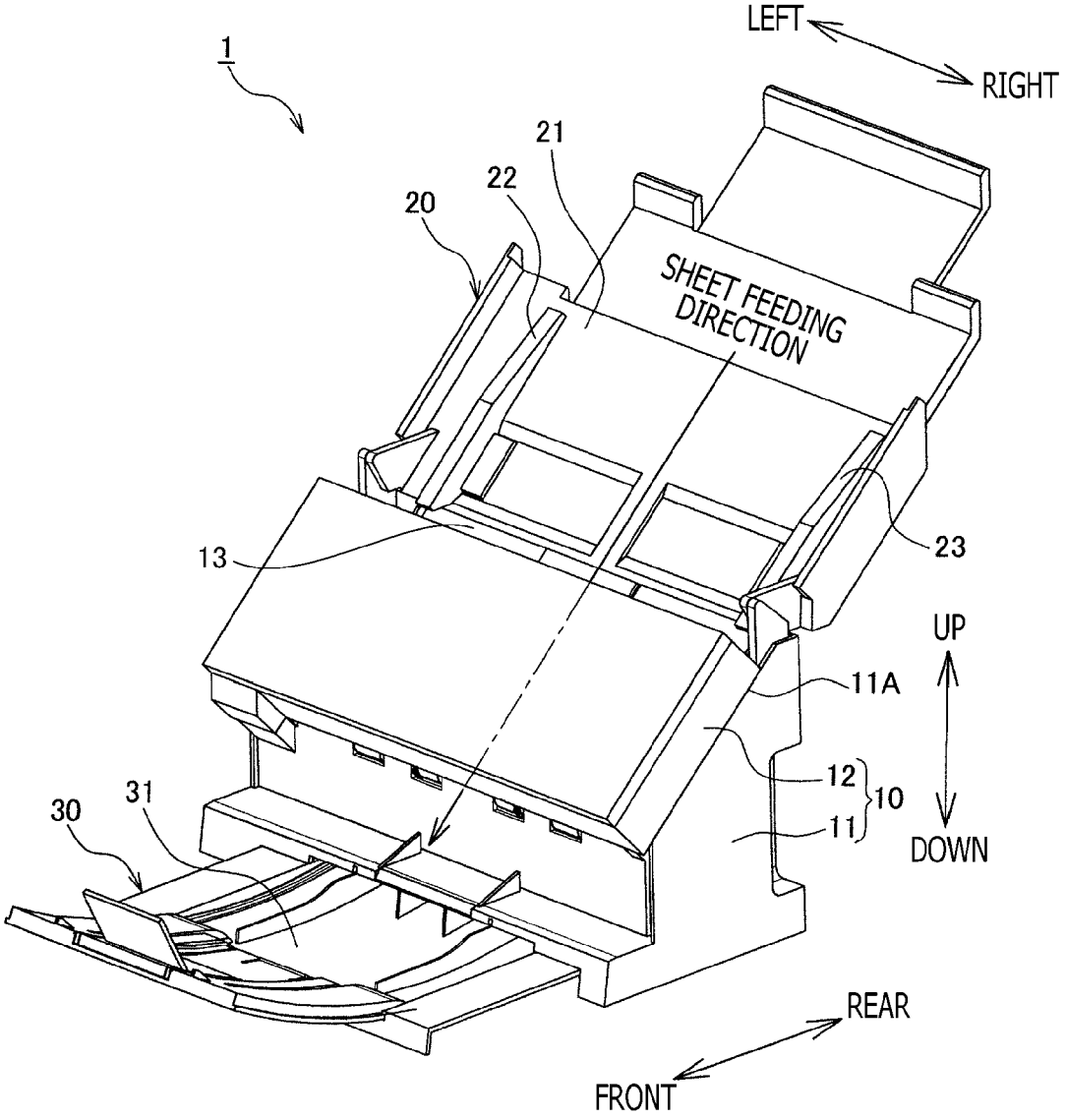
FIG. 1 is a perspective view showing an image reader in accordance with one or more aspects of the present disclosure.

In the following description, a vertical direction, a left-to-right direction, and a front-to-rear direction of an image reader 1 of the illustrative embodiment will be defined as shown in the drawings for the sake of concise explanation of relative positional relationships between elements included in the image reader 1. As shown in FIG. 1, the image reader 1, which is an example of a sheet feeder, includes a housing 10, a feed tray 20, and a discharge tray 30. The image reader 1 includes, inside the housing 10, a sheet feeding mechanism 40 (see FIGS. 2A and 2B), a conveyance mechanism (not shown), an image reading unit (not shown), a power supply unit (not shown), and a board (not shown).

[1. 1. Configuration of Housing]

As shown in FIG. 1, the housing 10 includes a first housing 11 and a second housing 12. The first housing 11 and the second housing 12 are disposed apart from each other. There is an opening 11A formed by the first housing 11 and an upper end portion of the second housing 12. An upper surface of the first housing 11 is inclined downward in a direction from a rear end to a front end of the first housing 11. A lower front end portion of the second housing 12 is attached to an upper front end portion of the first housing 11 to be rotatable around a rotational axis extending in the left-to-right direction. Thereby, the second housing 12 rotates with a rear end portion thereof being lifted upward. The second housing 12 is configured to rotate between a closed position and an open position. In the closed position, an upper end portion of the second housing 12 is positioned close to the first housing 11. Meanwhile, in the open position, the upper end portion of the second housing 12 is positioned away from the first housing 11. Between the upper surface of the first housing 11 and a lower surface of the second housing 12, a conveyance pathPis provided to convey a sheet from the feed tray 20 to the discharge tray 30.

The upper surface of the first housing 11 is a chute 13 that forms the conveyance path P. The chute 13 is disposed at a front end portion of the feed tray 20. The chute 13 is inclined downward as extending frontward. The chute 13 is configured to guide a sheet placed on the feed tray 20, obliquely toward a lower front side.

[1. 2. Configuration of Feed Tray]

As shown in FIG. 1, the feed tray 20 is attached to an upper rear end portion of the first housing 11 to be rotatable around a rotational axis extending in the left-to-right direction.

An upward-facing surface of the feed tray 20 is a placement surface 21 on which a sheet is placed. Further, to the placement surface 21, side guides 22 and 23 are attached. The side guides 22 and 23 are spaced apart from each other in the left-to-right direction. The side guides 22 and 23 are configured to slide along the left-to-right direction relative to the placement surface 21. Each individual one of the side guides 22 and 23 is configured to slide in one direction along the left-to-right direction in conjunction with the other side guide sliding in the other opposite direction along the left-to-right direction.

[1. 3. Configuration of Discharge Tray]

As shown in FIG. 1, the discharge tray 30 is configured to be drawn frontward from a lower front end portion of the first housing 11. An upward-facing surface of the discharge tray 30 drawn frontward from the first housing 11 is a placement surface 31 for receiving a sheet discharged thereon.

[1. 4. Configuration of Sheet Feeding Mechanism]

As shown in FIGS. 2A, 2B, 3A, and 3B, the sheet feeding mechanism 40 is disposed at portions, close to the opening 11A, of the first housing 11 and the second housing 12. The sheet feeding mechanism 40 includes a pickup roller 41, a retard roller 42 (see FIG. 4), a set guide 43, a stopper 44, a driving mechanism 45 (see FIG. 4), and a supporter 46.

[1. 4. 1. Configuration of Supporter]

Figure 2A:
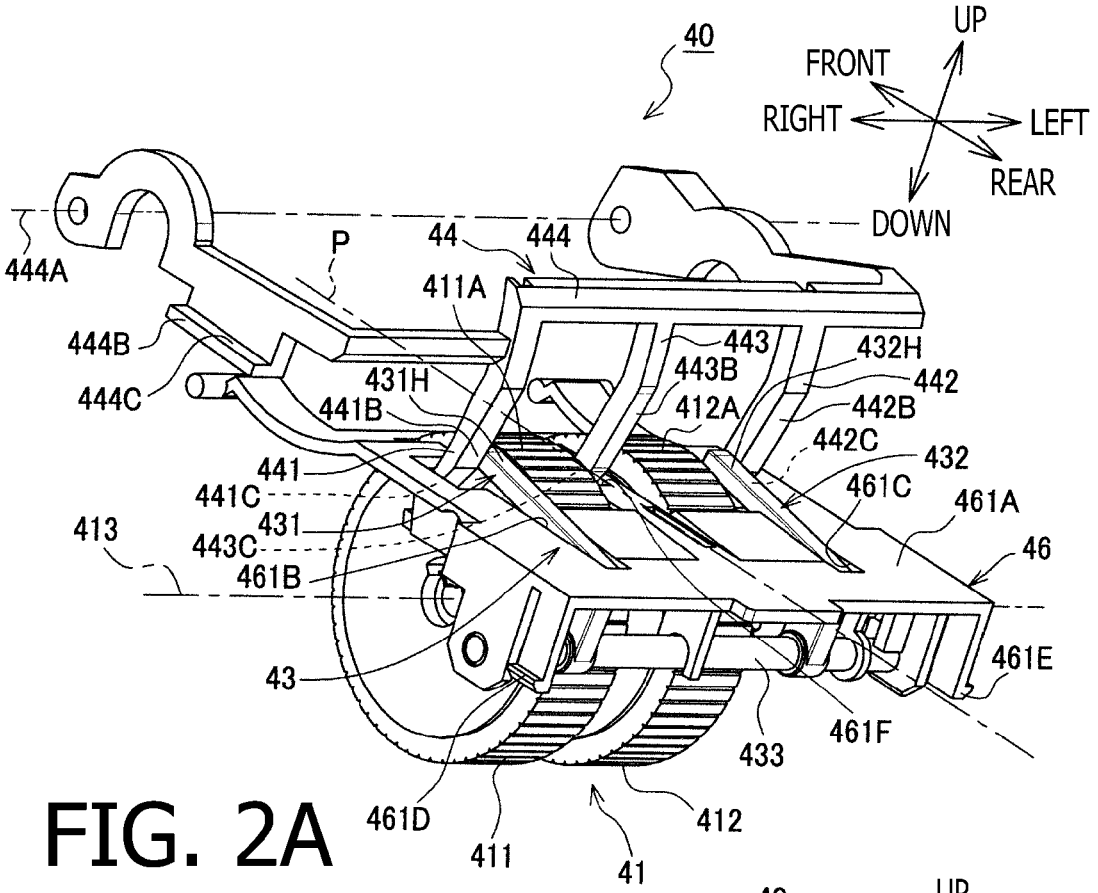
FIG. 2A is a perspective view showing a sheet feeding mechanism of the image reader in a state where a stopper is in a first position, and a set guide is in a third position, in accordance with one or more aspects of the present disclosure.

As shown in FIG. 2A, the supporter 46 has an upward-facing surface 461A. The surface 461A includes a first opening 461B, a second opening 461C, and a third opening 461F. The first opening 461B is formed in a right area within the surface 461A. The second opening 461C is formed in a left area within the surface 461A. Through the first opening 461B, a first roller 411 of the pickup roller 41 and a first set guide 431 of the set guide 43 are inserted. A first stopper 441 of the stopper 44 is allowed to be inserted through the first opening 461B. The first roller 411, the first set guide 431, and the first stopper 441 will be described later. Through the second opening 461C, a second roller 412 of the pickup roller 41 and a second set guide 432 of the set guide 43 are inserted. A second stopper 442 of the stopper 44 is allowed to be inserted through the second opening 461C. The second roller 412, the second set guide 432, and the second stopper 442 will be described later. The third opening 461F is formed in a central area within the surface 461A (i.e., the third opening 461F is formed between the first opening 461B and the second opening 461C in the left-to-right direction). Through the third opening 461F, a third stopper 443 of the stopper 44 is allowed to be inserted. The third stopper 443 will be described later.

At a right rear end portion of the supporter 46, a first pawl portion 461D is formed. The first pawl portion 461D is engaged with the first housing 11. At a left rear end portion of the supporter 46, a second pawl portion 461E is formed. The second pawl portion 461E is engaged with the first housing 11. Thereby, the supporter 46 is fixedly attached to the first housing 11.

A right front end portion of the supporter 46 extends frontward further than a central front end portion thereof. A distal end of the right front end portion of the supporter 46 is attached to the first housing 11. A left front end portion of the supporter 46 extends frontward further than the central front end portion thereof. A distal end of the left front end portion of the supporter 46 is attached to the first housing 11.

[1. 4. 2. Configuration of Pickup Roller]

As shown in FIG. 2A, the pickup roller 41 includes the first roller 411 and the second roller 412. The first roller 411 and the second roller 412 are attached to the first housing 11 via the same rotational shaft (not shown) extending in the left-to-right direction. The first roller 411 and the second roller 412 are disposed apart from each other, along a pickup roller axis 413.

The first roller 411 is rotatable around the pickup roller axis 413 extending in the left-to-right direction. A roller surface 411A of the first roller 411 protrudes from the surface 461A. More specifically, the roller surface 411A protrudes through the first opening 461B and is exposed onto the conveyance path P. The roller surface 411A is configured to contact a sheet placed on the supporter 46, i.e., a sheet placed on the placement surface 21 of the feed tray 20.

The second roller 412 is rotatable around the pickup roller axis 413 extending in the left-to-right direction. A roller surface 412A of the second roller 412 protrudes through the second opening 461C and is exposed onto the conveyance path P. The roller surface 412A is configured to contact the sheet placed on the supporter 46, i.e., the sheet placed on the placement surface 21 of the feed tray 20.

The first roller 411 and the second roller 412 are configured to rotate around the same rotational axis 413 in synchronization with each other, such that an exposed portion of the roller surface 411A from the first opening 461B and an exposed portion of the roller surface 412A from the second opening 461C move in the sheet feeding direction. Namely, in a side view from the right, as the first roller 411 and the second roller 412 rotate counterclockwise while contacting the sheet placed on the supporter 46 (i.e., the sheet placed on the placement surface 21 of the feed tray 20), the sheet is conveyed in the sheet feeding direction. The sheet feeding direction may be a frontward direction.

[1. 4. 3. Configuration of Retard Roller]

The retard roller 42 is disposed to face the pickup roller 41. The retard roller 42 is configured to convey sheets on a sheet-by-sheet basis downstream in the sheet feeding direction, in cooperation with the pickup roller 41.

[1. 4. 4. Configuration of Stopper]

Figure 2B:
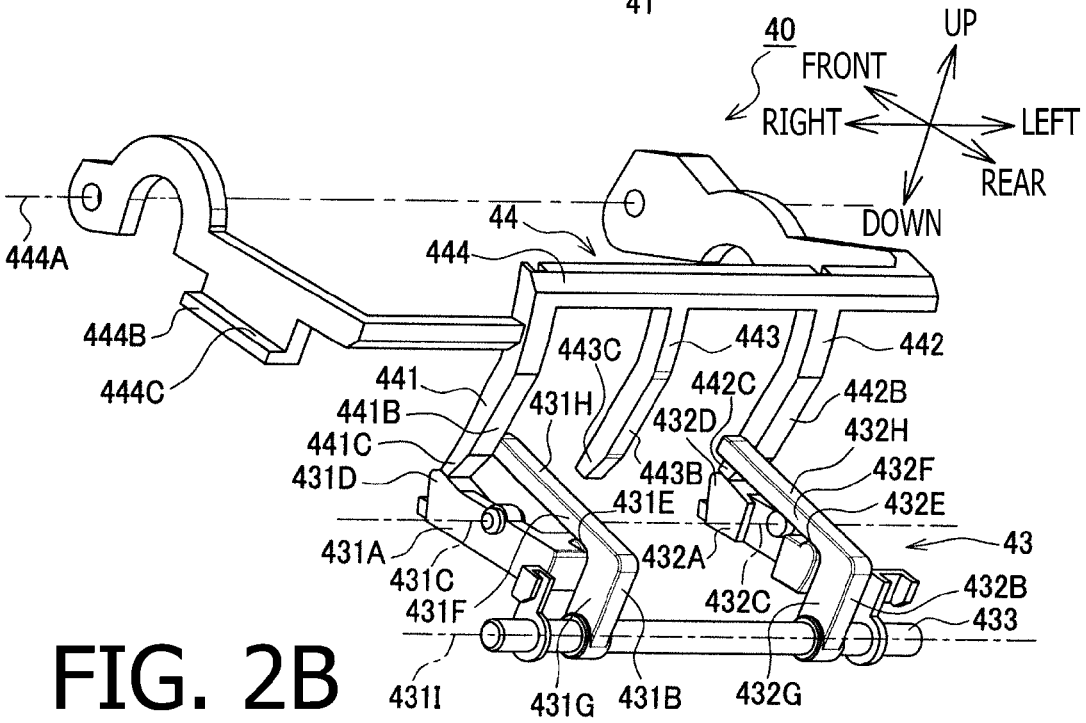
FIG. 2B is a perspective view showing the sheet feeding mechanism from which one or more components are removed, in the state where the stopper is in the first position, and the set guide is in the third position, in accordance with one or more aspects of the present disclosure.

As shown in FIGS. 2A and 2B, the stopper 44 includes the first stopper 441, the second stopper 442, the third stopper 443, and a supporting member 444.

The supporting member 444 includes an upper-rear section extending in the left-to-right direction above the supporter 46. The supporting member 444 further includes a right section extending frontward from a right end portion of the upper-rear section. A right hole is formed in a right distal end portion of the right section of the supporting member 444. The supporting member 444 further includes a left section extending frontward from a left end portion of the upper-rear section extending in the left-to-right direction above the supporter 46. A left hole is formed in a left distal end portion of the left section of the supporting member 444. The second housing 12 includes a rotational shaft (not shown) extending in the left-to-right direction. The rotational shaft is inserted into the left hole and the right hole of the supporting member 444. The supporting member 444 is rotatable around a third rotational axis 444A that passes through the left hole and the right hole of the supporting member 444 and extends along the left-to-right direction. A protrusion 444B is formed to protrude rightward from a right end portion of the right section of the supporting member 444. The protrusion 444B has an upper surface 444C facing upward.

The first stopper 441, the second stopper 442, and the third stopper 443 extend downward from the upper-rear section, respectively. The first stopper 441, the second stopper 442, and the third stopper 443 are spaced apart from each other in the left-to-right direction. The first stopper 441 is opposed to the second roller 412 with respect to the first roller 411 in the direction along the pickup roller axis 413. The first stopper 441 has a second surface 441B facing in a direction (e.g., a rearward direction) opposite to the sheet feeding direction.

The second stopper 442 is opposed to the first roller 411 with respect to the second roller 412 in the direction along the pickup roller axis 413. The second stopper 442 has a second surface 442B facing in the direction (e.g., the rearward direction) opposite to the sheet feeding direction.

The third stopper 443 is disposed between the first roller 411 and the second roller 412 in the direction along the pickup roller axis 413. The third stopper 443 has a second surface 443B facing in the direction (e.g., the rearward direction) opposite to the sheet feeding direction. In other words, the first roller 411 is disposed between the first stopper 441 and the third stopper 443 in the direction along the pickup roller axis 413. The second roller 412 is disposed between the second stopper 442 and the third stopper 443 in the direction along the pickup roller axis 413.

The stopper 44 is configured to rotate around the third rotational axis 444A, between a first position and a second position. When in the first position, the stopper 44 is close to the pickup roller 41. When the stopper 44 is in the first position, a distal end portion (e.g., a lower end portion 441C) of the first stopper 441 is inserted into the first opening 461B. When the stopper 44 is in the first position, a lower end portion 442C of the second stopper 442 is inserted into the second opening 461C. When the stopper 44 is in the first position, a lower end portion 443C of the third stopper 443 is inserted into the third opening 461F.

When the stopper 44 is in the first position, the lower end portion 441C of the first stopper 441 is positioned below an upper end of the roller surface 411A of the first roller 411 and an upper end of the roller surface 412A of the second roller 412. In addition, when the stopper 44 is in the first position, the lower end portion 442C of the second stopper 442 is positioned below the upper end of the roller surface 411A of the first roller 411 and the upper end of the roller surface 412A of the second roller 412. Further, when the stopper 44 is in the first position, the lower end portion 443C of the third stopper 443 is positioned below the upper end of the roller surface 411A of the first roller 411 and the upper end of the roller surface 412A of the second roller 412. In other words, when the stopper 44 is in the first position, the lower end portion 441C of the first stopper 441, the lower end portion 442C of the second stopper 442, and the lower end portion 443C of the third stopper 443 are closer to the pickup roller axis 413 than the upper end of the roller surface 411A of the first roller 411 and the upper end of the roller surface 412A of the first roller 412. Accordingly, the sheet placed on the supporter 46 contacts at least one of the second surface 441B of the first stopper 441, the second surface 442B of the second stopper 442, and the second surface 443B of the third stopper 443, and is prevented from entering in the sheet feeding direction. In other words, the first position is a restriction position where the stopper 44 restricts the sheet from being fed downstream in the sheet feeding direction by the first roller 411 and the second roller 412. The stopper 44 placed in the first position interrupts the conveyance path P.

When in the second position, the stopper 44 is separated away from the pickup roller 41 in the vertical direction. When the stopper 44 is in the second position, the lower end portion 441C of the first stopper 441 is above the first opening 461B. When the stopper 44 is in the second position, the lower end portion 442C of the second stopper 442 is above the second opening 461C. When the stopper 44 is in the second position, the lower end portion 443C of the third stopper 443 is above the third opening 461C. When the stopper 44 is in the second position, the lower end portion 441C of the first stopper 441 is positioned above an upper end of the roller surface 411A of the first roller 411 and an upper end of the roller surface 412A of the second roller 412. In addition, when the stopper 44 is in the first position, the lower end portion 442C of the second stopper 442 is positioned above the upper end of the roller surface 411A of the first roller 411 and the upper end of the roller surface 412A of the second roller 412. Further, when the stopper 44 is in the first position, the lower end portion 443C of the third stopper 443 is positioned above the upper end of the roller surface 411A of the first roller 411 and the upper end of the roller surface 412A of the second roller 412. In other words, when the stopper 44 is in the second position, the lower end portion 441C of the first stopper 441, the lower end portion 442C of the second stopper 442, and the lower end portion 443C of the third stopper 443 are farther from the pickup roller axis 413 than the upper end of the roller surface 411A of the first roller 411 and the upper end of the roller surface 412A of the first roller 412. Accordingly, the sheet placed on the supporter 46 does not contact the second surface 441B of the first stopper 441, the second surface 442B of the second stopper 442, or the second surface 443B of the third stopper 443, and is allowed to enter in the sheet feeding direction. In other words, the second position is a permission position where the stopper 44 permits the sheet to be fed downstream in the sheet feeding direction by the first roller 411 and the second roller 412. The stopper 44 placed in the second position does not interrupt the conveyance path P.

The stopper 44 is urged by an urging force from an urging spring 445 in such a manner as to rotate counterclockwise around the third rotational axis 444A in a view from the right (i.e., in a right side view). Trajectories of the second surfaces 441B, 442B, and 443B of the stopper 44 rotating between the first position and the second position are positioned downstream, in the sheet feeding direction, of the second surfaces 441B, 442B, and 443B of the stopper 44 staying in the first position.

Hereinafter, the second surface 441B will be described. As shown in FIG. 3B, when the stopper 44 is in the first position, a perpendicular line PL is defined as a straight line perpendicular to a linear line connecting the third rotational axis 444A and a lower end A of the second surface 441B. A trajectory of the lower end A of the second surface 441B, when the stopper 44 rotates between the first position and the second position, is drawn as an arc with a radius of a distance between the third rotational axis 444A and the lower end A of the second surface 441B. A trajectory of an upper end B of the second surface 441B when the stopper 44 rotates between the first position and the second position is drawn as an arc with a radius of a distance between the third rotational axis 444A and the upper end B of the second surface 441B. As shown in FIG. 6B, a trajectory of a range from the lower end A to the upper end B of the second surface 441B, when the stopper 44 rotates between the first position and the second position, is positioned downstream of the perpendicular line PL in the sheet feeding direction. The same applies to the second surface 442B and the second surface 443B.

[1. 4. 5. Configuration of Set Guide]

As shown in FIGS. 2A and 2B, the set guide 43 includes the first set guide 431 and the second set guide 432. The first set guide 431 and the second set guide 432 are attached to the supporter 46. The first set guide 431 is opposed to the second roller 412 with respect to the first roller 411 in a direction along the pickup roller axis 413. The second set guide 432 is opposed to the first roller 411 with respect to the second roller 412 in the direction along the pickup roller axis 413. Namely, the first roller 411 and the second roller 412 are positioned between the first set guide 431 and the second set guide 432 in the direction along the pickup roller axis 413.

The first set guide 431 includes a first member 431A and a second member 431B. The first member 431A extends substantially in the front-to-rear direction. At a middle portion of the first member 431A in the front-to-rear direction, a rightward-protruding shaft is formed. It is noted that, for instance, the middle portion of the first member 431A in the front-to-rear direction may be a portion of the first member 431A other than below-mentioned end portions 431D and 431F. The shaft is inserted into a hole formed at the first housing 11. The first member 431A is configured to rotate around a first rotational axis 431C for the first set guide 431. The first rotational axis 431C is along the pickup roller axis 413 (e.g., the first rotational axis 431C may be parallel to the pickup roller axis 413). An end portion 431D of the first member 431A is positioned downstream of the first rotational axis 431C in the sheet feeding direction. The end portion 431D of the first member 431A in the sheet feeding direction is disposed below the lower end portion 441C of the first stopper 441.

The second member 431B includes a first section 431F and a second section 431G. The first section 431F extends substantially in the front-to-rear direction. The second section 431G extends substantially in the vertical direction. A rear end portion of the first section 431F is connected with an upper end portion of the second section 431G. The first section 431F has a first surface 431H facing upward. In other words, the first surface 431H faces in such a direction as to become farther away from a surface (e.g., the roller surface 411A) of the pickup roller 41. The second section 431G extends substantially in a direction intersecting the first surface 431H. At a lower end portion of the second section 431G, a hole is formed. A shaft 433 is inserted through the hole. The shaft 433 extends along a second rotational axis 4311 in the left-to-right direction. The second rotational axis 4311 is along the pickup roller axis 413 (e.g., the second rotational axis 4311 may be parallel to the pickup roller axis 413). The second member 431B is configured to rotate around the second rotational axis 4311. As shown in FIGS. 3A, 3B, 6A and 6B, the second rotational axis 4311 is positioned upstream of an end portion 431E in the sheet feeding direction. The shaft 433 is supported by the supporter 46. The second member 431B rotates relative to the shaft 433. Alternatively, the shaft 433 may be rotatably supported by the supporter 46, and the second member 431B may rotate integrally with the shaft 433.

The first section 431F is disposed above the end portion 431E of the first member 431A in the sheet feeding direction. The end portion 431E is opposed to the end portion 431D with respect to the first rotational axis 431C in the sheet feeding direction. In other words, the end portion 431E is positioned upstream of the first rotational axis 431C in the sheet feeding direction. The second section 431G is disposed behind (i.e., on a rear side of) the end portion 431E of the first member 431A.

The second set guide 432 includes a first member 432A and a second member 432B. The first member 432A is configured to rotate around a first rotational axis 432C for the second set guide 432. The first rotational axis 432C is along the pickup roller axis 413 (e.g., the first rotational axis 432C may be parallel to the pickup roller axis 413). An end portion 432D of the first member 432A is positioned downstream of the first rotational axis 432C in the sheet feeding direction. The end portion 432D is disposed below the lower end portion 442C of the second stopper 442.

The second member 432B of the second set guide 432 includes a first section 432F and a second section 432G. The first section 432F extends substantially in the front-to-rear direction. The second section 432G extends substantially in the vertical direction. A rear end portion of the first section 432F is connected with an upper end portion of the second section 432G. The first section 432F has a first surface 432H facing upward. In other words, the first surface 432H faces in such a direction as to become farther away from a surface of the pickup roller 41. The second section 432G extends in a direction intersecting the first surface 432H. At a lower end portion of the second section 432G, a hole is formed. The shaft 433 is inserted through the hole. The second member 432B is configured to rotate around the second rotational axis 4311. The second member 432B rotates relative to the shaft 433. Alternatively, the shaft 433 may be rotatably supported by the supporter 46, and the second member 432B may rotate integrally with the shaft 433.

The first section 432F is disposed above an end portion 432E of the first member 432A in the sheet feeding direction. The end portion 432E is opposed to the end portion 432D with respect to the first rotational axis 432C in the sheet feeding direction. In other words, the end portion 432E is positioned upstream of the first rotational axis 432C in the sheet feeding direction. The second section 432G is disposed behind (i.e., on a rear side of) the end portion 432E of the first member 432A.

The set guide 43 is configured to move between a third position and a fourth position. As shown in FIGS. 2A, 2B, 3A, and 3B, when the set guide 43 is in the third position, the first surface 431H and 432H are positioned above all the surface of the pickup roller 41. Namely, as the set guide 43 moves to the third position, the first surfaces 431H and 432H move in such a direction as to become farther away from the surface of the pickup roller 41. Consequently, when the set guide 43 is in the third position, the sheet placed on the first surfaces 431H and 432H of the set guide 43 does not contact the pickup roller 41. When the set guide 43 is in the third position, the end portion 431D of the first set guide 431 contacts the lower end portion 441C of the first stopper 441 in the first position. When the set guide 43 is in the third position, the end portion 432D of the second set guide 432 contacts the lower end portion 442C of the second stopper 442 in the first position.

As shown in FIGS. 5A, 5B, 6A, and 6B, when the set guide 43 is in the fourth position, at least a part of the surface of the pickup roller 41 is positioned above the first surfaces 431H and 432H. When the set guide 43 is in the fourth position, the end portion 431D of the first set guide 431 is separated away from the lower end portion 441C of the first stopper 441 in the second position. When the set guide 43 is in the fourth position, the end portion 432D of the second set guide 432 is separated away from the lower end portion 442C of the second stopper 442 in the second position. Consequently, when the set guide 43 is in the third position, the sheet placed on the first surfaces 431H and 432H of the set guide 43 does not contact the pickup roller 41.

Figure 3A:
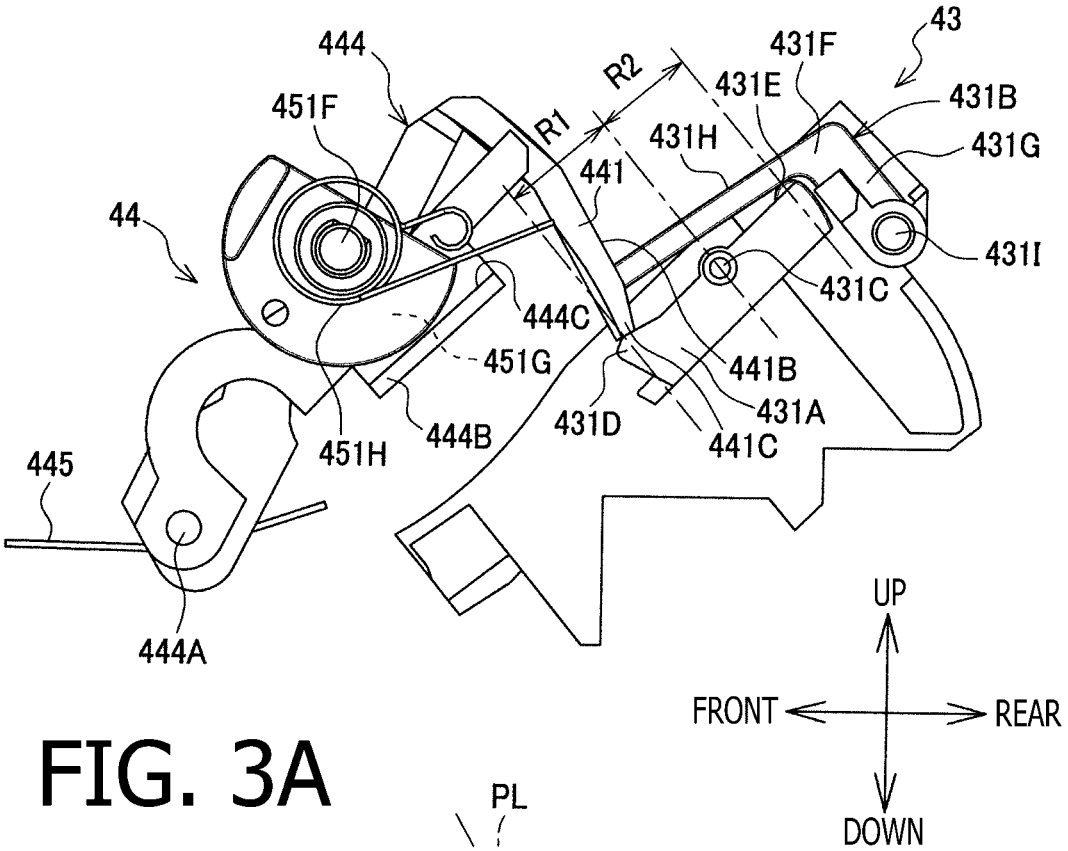
FIG. 3A is a side view showing the sheet feeding mechanism of the image reader in the state where the stopper is in the first position, and the set guide is in the third position, in accordance with one or more aspects of the present disclosure.
Figure 3B:
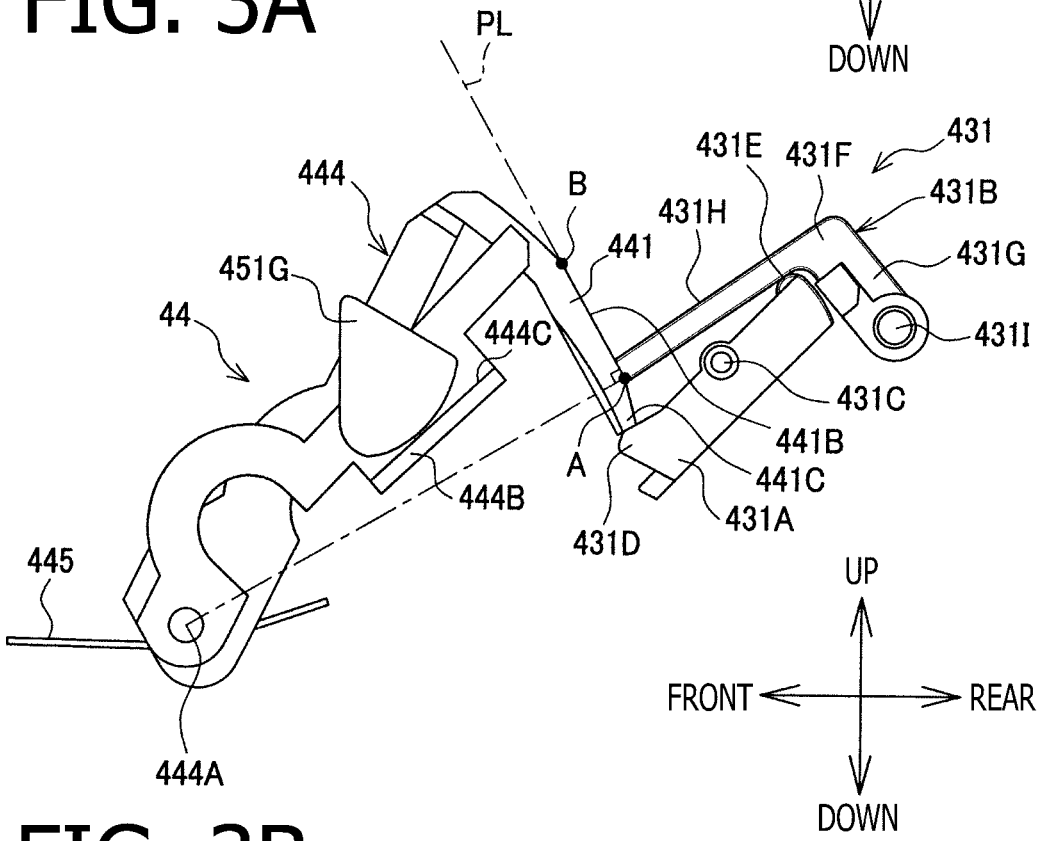
FIG. 3B is a side view showing the sheet feeding mechanism from which one or more components are removed, in the state where the stopper is in the first position, and the set guide is in the third position, in accordance with one or more aspects of the present disclosure.

As shown in FIG. 3A, a distance R1 between the first rotational axis 431C for the first set guide 431 and the end portion 431D of the first member 431A of the first set guide 431 is equal to or more than a distance R2 between the first rotational axis 431C and a contact position (e.g., the end portion 431E) with the second member 431B of the first set guide 431. A distance R1 between the first rotational axis 432C for the second set guide 432 and the end portion 432D of the first member 432A of the second set guide 432 is equal to or more than a distance R2 between the first rotational axis 432C and a contact position (e.g., the end portion 432E) with the second member 432B of the second set guide 432.

[1. 4. 6. Configuration of Driving Mechanism]

As shown in FIG. 4, the driving mechanism 45 includes a first driving mechanism 451 and a second driving mechanism 452.

The first driving mechanism 451 includes a lower driving mechanism 451A and an upper driving mechanism 451B. The lower driving mechanism 451A is attached to the first housing 11. The lower driving mechanism 451A includes a motor M1 for the retard roller 42. From the motor M1, an output shaft extends along the left-to-right direction. An output gear is attached to an end portion of the output shaft. A belt M1C is wound around a gear group including the output gear, a gear 102A, and a gear 102B. The gear 102A is attached to an end portion of a rotational shaft 451C extending in the left-to-right direction. The rotational shaft 451C is rotatable along with rotation of the gear 102A. Conveyance rollers 451C1 and 451 C2 are attached to the rotational shaft 451C. The conveyance rollers 451C1 and 451C2 are rotated by a driving force generated by rotation of the motor M1. Specifically, when the motor M1 is rotated in a forward direction, the conveyance rollers 451 C1 and 451 C2 are rotated in such a rotational direction as to convey a sheet in the sheet feeding direction. A gear 102C is attached to the other end portion of the rotational shaft 451C. There are gears 103A, 104A, and 105A disposed between the gear 102C and a gear 106A. The driving force generated by the rotation of the motor M1 is transmitted to the gear 106A via the gears 102A, 102C, 103A, 104A, and 105A. Rotation of the gear 106A is transmitted to a below-mentioned gear 107A of the upper driving mechanism 451B. The gear 102B is attached to an end portion of a rotational shaft 451D. The rotational shaft 451D is rotatable along with rotation of the gear 102B. Discharge rollers 451D1 and 451D2 are attached to the rotational shaft 451D. The discharge rollers 451D1 and 451 D2 are rotated by the driving source generated by the rotation of the motor M1. Specifically, when the motor M1 is rotated in the forward direction, the discharge rollers 451D1 and 451D2 are rotated in such a rotational direction as to convey a sheet in the sheet feeding direction. A one-way clutch (not shown) is attached between the rotational shaft 451D and the gear 102B. Thereby, even though the motor M1 is rotated in a backward direction, the driving force from the motor M1 is not transmitted to any of the discharge rollers 451D and 451 D2.

The upper driving mechanism 451B is attached to the second housing 12. The upper driving mechanism 451B includes the gear 107A. The gear 107A engages with the gear 106A. The gear 107A is engaged with a gear 108A and a gear 115A. The gear 108A is attached to an end portion of a rotational shaft 108B extending in the left-to-right direction. A gear 108C is attached to the other end portion of the rotational shaft 108B. There is a gear 109A disposed between the gear 108C and a gear 110A. The gear 110A is attached to an end portion of a rotational shaft 451E of the retard roller 42. Rotation of the gear 107A is transmitted to the gear 110A via the gear 108C and the gear 109A. Rotation of the gear 110A is transmitted to the retard roller 42 via the rotational shaft 451E. Between the gear 110A and the retard roller 42, a torque limiter (not shown) is attached. When the motor M1 is rotated in the forward direction, the retard roller 42 is rotated in a rotational direction opposite to such a direction as to convey a sheet in the sheet feeding direction. Thereby, when a plurality of sheets are fed between the pickup roller 41 and the retard roller 42, the plurality of sheets are separated and conveyed downstream in the sheet feeding direction on a sheet-by-sheet basis. Meanwhile, when a single sheet is fed between the pickup roller 41 and the retard roller 42, the torque limiter causes the retard roller 42 to rotate in such a rotational direction as to convey the single sheet in the sheet feeding direction.

The gear 115A is attached to an end portion of a rotational shaft 451F. As shown in FIG. 3B, a cam 451G is attached to the other end portion of the rotational shaft 451F. The driving force from the motor M1 is transmitted to the rotational shaft 451F via the gear 115A. Rotation of the rotational shaft 451F is transmitted to the cam 451G. There is a one-way clutch (not shown) attached between the rotational shaft 451F and the gear 115A. Thereby, when the motor M1 is rotated in the forward direction, the driving force from the motor M1 is not transmitted to the rotational shaft 451F via the gear 115A. Meanwhile, when the motor M1 is rotated in the backward direction, the driving force from the motor M1 is transmitted to the rotational shaft 451F via the gear 115A, and is transmitted to the cam 451G.

As shown in FIG. 3A, the rotational shaft 451F is urged by an urging spring 451H counterclockwise in the right side view. The cam 451G engages with the protrusion 444B of the supporting member 444 from above. When the cam 451G presses down the protrusion 444B along with the rotation of the rotational shaft 451F, the stopper 44 is moved to the first position. When the cam 451G is separated away from the protrusion 444B along with the rotation of the rotational shaft 451F, the stopper 44 is moved to the second position by the urging force from the urging spring 445.

The second driving mechanism 452 is attached to the first housing 11. The second mechanism 452 includes a motor M2 for the pickup roller 41. From the motor M2, an output shaft extends along the left-to-right direction. An output gear is attached to an end portion of the output shaft. A belt M2C is wound around a gear group including the output gear and a gear 111A. A gear 114A is attached to an end portion of a rotational shaft 452A. The other end portion of the rotational shaft 452A is attached to the pickup roller 41. Between the gear 111A and the gear 114A, a gear 112A and a gear 113A are disposed. A driving force generated by rotation of the motor M is transmitted to the rotational shaft 452A via the gears 111A, 112A, 113A, and 114A. When the rotational shaft 452A is rotated, the pickup roller 41 is rotated in such a rotational direction as to convey a sheet in the sheet feeding direction.

[2. Operations of Image Reader]

Subsequently, operations of the image reader 1 will be described. When the image reader 1 is powered on, a controller (not shown) rotates the motor M1 in the backward direction. Consequently, as shown in FIGS. 2A, 2B, 3A, and 3B, the stopper 44 is moved from the second position to the first position. Specifically, as shown in FIG. 6B, in a state where the motor M1 is not supplied with electricity, the stopper 44 is in the second position. When the stopper 44 is in the second position, the cam 451G is urged by the urging spring 451H attached to the rotational shaft 451F counterclockwise in the right side view. A flat surface of the cam 451G comes into contact with an upper surface 444C of the protrusion 444B urged upward by the urging spring 445. When the motor M1 rotates in the backward direction, the cam 451G is rotated by the driving force transmitted from the motor M1 via the rotational shaft 451F. Thereby, as shown in FIG. 3B, a curved surface of the cam 451G presses down the protrusion 444B. Thus, the stopper 44 is moved to the first position. When the stopper 44 is moved to the first position, the set guide 43 is moved from the fourth position to the third position. Specifically, the lower end portion 441C of the first stopper 441 is moved downward to press down the end portion 431D of the first member 431A. When the end portion 431D is pressed down, the first member 431A rotates around the first rotational axis 431C. Thereby, the end portion 431E of the first member 431A is moved upward. When moved upward, the end portion 431E causes the first section 431F of the second member 431B to move upward. At this time, the second member 431B rotates around the second rotational axis 4311. Consequently, the set guide 43 is placed in the third position. As the set guide 43 is placed in the third position, the first surface 431H of the second member 431B is positioned downstream of all the surface of the pickup roller 41 in such a direction as to become farther away from the surface of the pickup roller 41 (i.e., the first surface 431H is substantially above all the surface of the pickup roller 41 in the vertical direction).

The lower end portion 442C of the second stopper 442 moves downward and presses down the end portion 432D of the second set guide 432 in the sheet feeding direction. When the end portion 432D of the second set guide 432 in the sheet feeding direction is pressed down, the first member 432A rotates around the first rotational axis 432C for the second set guide 432, the end portion 432E of the second set guide 432 in the sheet feeding direction is moved upward. When moved upward, the end portion 432E causes the first section 432F of the second member 432B of the second set guide 432 to move upward. At this time, the second member 432B of the second set guide 432 rotates around the second rotational axis 4321. Consequently, the set guide 43 is placed in the third position. As the set guide 43 is in the third position, the first surface 432H of the second member 432B is positioned downstream of all the surface of the pickup roller 41 in such a direction as to become farther away from the surface of the pickup roller 41 (i.e., the first surface 432H is substantially above all the surface of the pickup roller 41 in the vertical direction).

When sheets are set on the feed tray 20 in the open position, the set sheets are placed on the chute 13. The sheets are brought into a state where leading ends thereof in the sheet feeding direction are placed on the first surfaces 431H and 432H of the set guide 43 in the third position. The leading ends of the sheets in the sheet feeding direction do not contact the first roller 411 or the second roller 412 of the pickup roller 41. The leading ends of the sheets in the sheet feeding direction contact the stopper 44 in the first position. The leading ends of the sheets in the sheet feeding direction do not contact the retard roller 42 positioned downstream of the stopper 44 in the sheet feeding direction on the conveyance path P.

When receiving an instruction to read images of the sheets (i.e., a sheet feeding instruction) input via an operation unit (not shown) or a communication unit (not shown), the controller controls the motor M1 to rotate in the forward direction. As shown in FIGS. 5A, 5B, 6A, and 6B, by the forward rotation of the motor M1, the stopper 44 is moved from the first position to the second position, and the retard roller 42 rotates in the rotational direction opposite to such a direction as to convey the sheets in the sheet feeding direction. The controller controls the motor M2 to rotate in the forward direction. By the forward rotation of the M2, the pickup roller 41 rotates in such a rotational direction as to convey the sheets in the sheet feeding direction.

When the stopper 44 moves from the first position to the second position, the first set guide 431 and the second set guide 432 are released from the first stopper 441 and the second stopper 442, respectively. The set guide 43 is separated away from the stopper 44 and moves from the third position to the fourth position. More specifically, when the motor M1 rotates in the forward direction, the one-way clutch prohibits transmission of the driving force from the motor M1 to the rotational shaft 451F via the gear 115A. The cam 451G is urged by the urging spring 451H counterclockwise in the right side view. By the urging spring 445, the stopper 44 is rotated counterclockwise around the third rotational axis 443A in the right side view, and moves to the second position. When the stopper 44 is in the second position, the flat surface of the cam 451G is in contact with the upper surface 444C of the protrusion 444B. The lower end portion 441C of the first stopper 441 moves upward and is separated away from the end portion 431D of the first member 431A. When the lower end portion 441C is separated away from the end portion 431D, the first member 431A rotates by its own weight around the first rotational axis 431C for the first set guide 431, and the end portion 431E of the first member 431A in the sheet feeding direction moves downward. When moving downward, the end portion 431E is separated away from the first section 431F of the second member 431B. Then, the second section 431G of the second member 431B moves downward by its own weight. At this time, the second member 431B rotates around the second rotational axis 4311. Consequently, the set guide 43 is placed in the fourth position. As the set guide 43 is in the fourth position, a part of the surface of the pickup roller 41 is positioned above the first surface 431H of the first section 431F of the second member 431B.

The lower end portion 441C of the first stopper 441 is separated away from the first set guide 431 of the set guide 43. As being separated away from the first stopper 441, the first member 431A of the first set guide 431 rotates clockwise in the right side view. As rotating clockwise in the right side view, the first member 431A is separated away from the second member 431B of the first set guide 431. As being separated away from the first member 431A, the second member 431B rotates counterclockwise in the right side view, and at least a part of the surface of the pickup roller 41 is positioned downstream of the first surface 431H of the first section 431F (of the second member 431B of the first set guide 431) in such a direction as to become farther away from the surface of the pickup roller 41 (i.e., at least a part of the surface of the pickup roller 41 is substantially above the first surface 431H in the vertical direction).

The lower end portion 442C of the second stopper 442 is separated away from the second set guide 432 of the set guide 43. As being separated away from the second stopper 442, the first member 432A of the second set guide 432 rotates counterclockwise in a view from the left (i.e., in a left side view). As rotating counterclockwise in the left side view, the first member 432A is separated away from the second member 432B of the second set guide 432. As being separated away from the first member 432A, the second member 432B rotates clockwise in the left side view, and at least a part of the surface of the pickup roller 41 is positioned downstream of the first surface 432H of the first section 432F (of the second member 432B of the second set guide 432) in such a direction as to become farther away from the surface of the pickup roller 41 (i.e., at least a part of the surface of the pickup roller 41 is substantially above the first surface 432H in the vertical direction).

When the stopper 44 moves to the second position, and the set guide 43 moves to the fourth position, a gap is generated between the stopper 44 and the pickup roller 41. One or more sheets are inserted into the gap. The pickup roller 41 rotates in such a rotational direction as to convey the one or more sheets in the sheet feeding direction while pinching the one or more sheets with the retard roller 42. Thereby, the one or more sheets are conveyed downstream in the sheet feeding direction along the conveyance path P. When a plurality of sheets are about to be conveyed in a mutually-overlapping state, the plurality of sheets are separated on a sheet-by-sheet basis by a frictional force between the retard roller 42 and the sheets.

The conveyance mechanism such as the conveyance rollers 451C1 and 451C2 conveys, toward the image reading unit, the sheets separated on a sheet-by-sheet basis. The image reading unit reads images of the sheets. Output signals from the image reading unit are transmitted to the controller and converted into image data.

A discharge mechanism such as the discharge rollers 451D1 and 451D2 discharges, onto the discharge tray 30, the sheets of which the images have been read by the image reading unit. When having detected a signal from a sensor (not shown) indicating that there is not a sheet on the feed tray 20, the controller controls the motor M1 and moves the stopper 44 from the second position to the first position, as shown in FIGS. 2A, 2B, 3A, and 3B. Detailed operations when the controller controls the motor M1 and moves the stopper 44 from the second position to the first position are substantially the same as the aforementioned operations to move the stopper 44 from the second position to the first position. The set guide 43 is brought into contact with the stopper 44 in the first position and moves from the fourth position to the third position.

Specifically, the lower end portion 441C of the first stopper 441 comes into contact with the first set guide 431 of the set guide 43. As contacting the first stopper 441, the first member 431A of the first set guide 431 rotates counterclockwise in the right side view. As rotating counterclockwise in the right side view, the first member 431A comes into contact with the second member 431B of the first set guide 431. As contacting the first member 431A, the second member 431B rotates clockwise in the right side view, the first surface 431H of the second member 431B is positioned downstream of all the surface of the pickup roller 41 in such a direction as to become farther away from the surface of the pickup roller 41 (i.e., the first surface 431H is substantially above all the surface of the pickup roller 41 in the vertical direction).

The lower end portion 442C of the second stopper 442 comes into contact with the second set guide 432 of the set guide 43. As contacting the second stopper 442, the first member 432A of the second set guide 432 rotates clockwise in the left side view. As rotating clockwise in the left side view, the first member 432A comes into contact with the second member 432B of the second set guide 432. As contacting the first member 432A, the second member 432B rotates counterclockwise in the left side view, the first surface 432H of the second member 432B is positioned downstream of all the surface of the pickup roller 41 in such a direction as to become farther away from the surface of the pickup roller 41 (i.e., the first surface 432H is substantially above all the surface of the pickup roller 41 in the vertical direction).

[3. Advantageous Effects of Illustrative Embodiment]

(1) When the stopper 44 moves to the first position close to the pickup roller 41, the first stopper 441 of the stopper 44 comes into contact with the first set guide 431 of the set guide 43. The first surface 431H of the first set guide 431 is positioned downstream of all the surface of the pickup roller 41 in such a direction as to become farther away from the surface of the pickup roller 41 (i.e., the first surface 431H is substantially above all the surface of the pickup roller 41 in the vertical direction). The set guide 43 moves to the third position. As the sheets placed on the placement surface 21 of the feed tray 20 contact the second surface 441B of the first stopper 441 in the first position, the leading ends of the sheets in the sheet feeding direction become likely to be aligned. As the set guide 43 is in the third position, the first surface 431H of the first set guide 431 is positioned above all the surface of the pickup roller 41. Thereby, the sheets are less likely to, when placed on the placement surface 21, contact the pickup roller 41 protruding from the chute 13. Consequently, the leading ends of the sheets in the sheet feeding direction become likely to be aligned. The same applies to the second stopper 442 of the stopper 44 and the second set guide 432 of the set guide 43. When receiving an instruction to read images of the sheets, the controller controls the motor M1 and moves the first stopper 441 to the second position separated away from the first roller 411. When the first stopper 411 moves to the second position, the first set guide 431 is released from the first stopper 441. At least a part of the surface of the pickup roller 41 is positioned downstream of the first surface 431H of the first set guide 431 in such a direction as to become farther away from the surface of the pickup roller 41 (i.e., at least a part of the surface of the pickup roller 41 is substantially above the first surface 431H in the vertical direction). The same applies to the second stopper 442 and the second set guide 432. Thus, in response to the motor M1 being driven (i.e., by the motor M1), the stopper 44 is moved between the first position and the second position. Accordingly, it is possible to reduce a risk that the sheet being fed by the pickup roller 41 might be deformed or bent rather than moving the stopper 44 from the first position to the second position.

(2) The set guide 43 is rotatable around the first rotational axis 431C. The first rotational axis 431C is positioned substantially at a middle portion of the first member 431A in the extending direction (e.g., the front-to-rear direction) of the first member 431A, and is along the pickup roller axis 413. The first stopper 441 and the second stopper 442 contact the end portions 431D and 432D in the sheet feeding direction, respectively. Thus, the distance R1 between the first rotational axis 431C for the first set guide 431 and a point of effort (i.e., the end portion 431D of the first set guide 431) is longer than when the first stopper 441 is configured to contact the middle portion of the first member 431A in the extending direction of the first member 431A. The same applies to the second set guide 432 and the second stopper 442. Accordingly, when the stopper 44 is in the first position, it is possible to reduce a force required for the stopper 44 to place the set guide 43 in the third position while contacting the set guide 43.

(3) The first set guide 431 includes the first member 431A and the second member 431B. By the motor M1 (i.e., in response to the motor M1 rotating in the backward direction), the first stopper 44 is placed in the first position and comes into contact with the first member 431A. Thereby, the end portion 431E of the first member 431A contacts the second member 431B. As a result, the set guide 43 moves to the third position. By the motor M1 (i.e., in response to the motor M1 rotating in the forward direction), the first stopper 44 is placed in the second position. Thereby, the end portion 431E of the first member 431A is separated away from the second member 431B. Consequently, the set guide 43 moves to the fourth position. The same applies to the second set guide 432. For instance, by properly adjusting a relative positional relationship between the first member 431A and the second member 431B (e.g., by disposing the first member 431A below the second member 431B), it is possible to achieve a large movable range of the first surfaces 431H and 432H of the set guide 43 between above and below the upper end of the surface of the pickup roller 41. Thereby, it is possible to more certainly bring the sheet into contact and non-contact with the pickup roller 41.

(4) The second member 431B of the first set guide 431 includes the first section 431F and the second section 431G. The first section 431F has the first surface 431H. When the set guide 43 is in the third position, the second section 431G is separated away from the first member 431A. A distance between the second rotational axis 4311 and a point of effort (i.e., a portion of the first section 431F which is in contact with the end portion 431E) is longer than when the second section 431G and the first member 431A are configured to contact each other when the set guide 43 is in the third position. The same applies to the second set guide 43. Accordingly, when the stopper 44 is in the first position, it is possible to reduce a force required for the first members 431A and 432A of the set guide 43 to, while contacting the second members 431B and 432B, position the first surfaces 431H and 432H downstream of all the surface of the pickup roller 41 in such a direction as to become farther away from the surface of the pickup roller 41.

(5) When the stopper 441 is in the first position, the first member 431A of the first set guide 431 rotates around the first rotational axis 431C, and rotates the second member 431B around the second rotational axis 4311. At this time, the first member 431A receives forces from the first stopper 441 and the second member 431B. The same applies to the second set guide 432. According to the image reader 1 of the illustrative embodiment, in the first set guide 431, the distance R1 between the first rotational axis 431C and the end portion 431D of the first member 431A is equal to or more than the distance R2 between the first rotational axis 431C and the end portion 431E of the first member 431A in the sheet feeding direction. Thereby, the first member 431A is allowed to rotate the second member 431B with a smaller driving force. The same applies to the second set guide 432. Thus, it is possible to make smaller the driving force from the motor M1.

(6) When the image reader 1 is installed on a flat surface such as a desk surface, in the first set guide 431 of the set guide 43 in the third position, the first section 431F of the second member 431B extends in a direction between a vertically downward direction and a horizontal direction, from a contact position where the second member 431B contacts the end portion 431E of the first member 431A in the sheet feeding direction. Thereby, when the set guide 43 moves from the third position to the fourth position, the second member 431B is rotated by its own weight, and the first surface 431H easily moves from a position above the upper end of the first roller 411 toward a position below the upper end of the first roller 411. The same applies to the second set guide 432. Accordingly, it is possible to rotate the second members 431B and 432B of the set guide 43 with a simpler configuration.

(7) The first stopper 441 has the second surface 441B facing in the direction opposite to the sheet feeding direction. As the first stopper 441 rotates around the third rotational axis 444A, the stopper 44 rotates between the first position and the second position. The trajectory of the second surface 441B of the first stopper 441 when the stopper 44 rotates between the first position and the second position is positioned downstream, in the sheet feeding direction, of the second surface 441B of the first stopper 441 in the first position. Thereby, when the stopper 44 rotates from the first position to the second position, the first stopper 441 does not push back the sheet being in contact with the second surface 441B in the direction opposite to the sheet feeding direction. Consequently, it is possible to reduce a reaction force from the sheet which is pushed back by the first stopper 441 in the direction opposite to the sheet feeding direction. The same applies to the second stopper 442. As the reaction force is reduced, it is possible to reduce the driving force for the stopper 44.

(8) When the stopper 44 moves from the first position to the second position, the trajectories of the second surfaces 441B and 442B are drawn downstream of the perpendicular line PL in the sheet feeding direction. Consequently, it is possible to reduce a reaction force from the sheet that is caused by pushing back the sheet, which is in contact with the second surfaces 441B and 442B of the stopper 44 in the first position, in the direction opposite to the sheet feeding direction. Thus, it is possible to reduce a driving force for the stopper 44.

(9) The pickup roller 41 includes the first roller 411 and the second roller 412. The first roller 411 and the second roller 412 are disposed apart from each other along the pickup roller axis 413. The stopper 44 includes the first stopper 441, the second stopper 442, and the third stopper 443. The first stopper 441 is opposed to the second roller 412 with respect to the first roller 411 in a direction along the pickup roller axis 413. The second stopper 442 is opposed to the first roller 411 with respect to the second roller 412 in the direction along the pickup roller axis 413. The third stopper 443 is disposed between the first roller 411 and the second roller 412 in the direction along the pickup roller axis 413. Thereby, even when a sheet is used that has a width equal to or less than a length across the first roller 411 and the second roller 412 in the direction along the pickup roller axis 413, the third stopper 443 of the stopper 44 in the first position is allowed to contact the sheet.

(10) The set guide 43 includes the first set guide 431 and the second set guide 432. The first set guide 431 and the second set guide 432 are disposed to face each other across the pickup roller 41 in the direction along the pickup roller axis 413. The first set guide 431 and the second set guide 432 are attached to the shaft 433 along the pickup roller axis 413. Consequently, the first set guide 431 and the second set guide 432 are allowed to rotate in synchronization with each other. Thus, it is possible to align the leading ends, in the sheet feeding direction, of sheets conveyed by the pickup roller 41, and to effectively perform skew correction for the sheets.

(11) The first driving mechanism 451 includes the motor M1 for driving the retard roller 42 disposed to face the pickup roller 41. The first driving mechanism 451 serves as a transmission mechanism for transmitting the driving force from the motor M1 to the stopper 44. If a separate motor for driving the stopper 44 were provided, the separate motor would need to be driven in synchronization with the motor for driving the retard roller 42. However, according to the image reader 1 of the illustrative embodiment, there is no need for the aforementioned synchronization. Further, it is possible to achieve a simpler configuration of the image reader 1 than when a separate motor for driving the stopper 44 is provided.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

[Modification]

In the aforementioned illustrative embodiment, aspects of the present disclosure are applied to the image reader 1 including the reading unit. Nonetheless, the sheet feeder according to aspects of the present disclosure may not necessarily be required to include the reading unit. For instance, aspects of the present disclosure may be applied to an image forming apparatus configured to form an image on a sheet. In this case, the image forming apparatus may be configured to perform image formation in an electrophotographic method or an inkjet method. In the aforementioned illustrative embodiment, the set guide 43 includes the first member 431A and the second member 431B. Nonetheless, the set guide 43 may not necessarily be required to include the second member 431B. Specifically, for instance, by the driving force from the motor M1, the lower end portion 441C of the first stopper 441 may push down the end portion 431D of the first member 431A in the sheet feeding direction, and thereby, the end portion 431E of the first member 431A in the sheet feeding direction may move upward. Thus, in response to the stopper 44 moving to the first position, the end portion 431E may be positioned above the surface of the pickup roller 41, and the set guide 43 may move to the third position. Consequently, a sheet placed on an upper surface of the end portion 431E may not contact the surface of the pickup roller 41.

In the aforementioned illustrative embodiment, by the driving force from the motor M1, the stopper 44 is brought into contact with or separated away from the set guide 43. When the stopper 44 is in the first position, the set guide 43 is in the third position. Meanwhile, when the stopper 44 is in the second position, the set guide 43 is in the fourth position. Namely, the stopper 44 defines a restriction state where the stopper 44 restricts the sheet from being fed downstream in the sheet feeding direction by the pickup roller 41 and a permission state where the stopper 44 permits the sheet to be fed downstream in the sheet feeding direction by the pickup roller 41. Switching between the restriction state and the permission state is performed by the motor M1. Further, when the stopper 44 is brought into the restriction state by the motor M1, the set guide 43 comes into a non-contact state to bring the sheet into non-contact with the pickup roller 41, in synchronization with the stopper 44. When the stopper 44 is brought into the permission state by the motor M1, the set guide 43 comes into a contact state to bring the sheet into contact with the pickup roller 41, in synchronization with the stopper 44. The synchronized movements of the stopper 44 and the set guide 43 are not limited to their movements such as the stopper 44 being brought into contact with the set guide 43 and the stopper 44 being separated away from the set guide 43. For instance, when the controller determines that a particular sensor (not shown) has detected that the stopper 44 has moved to the first position, the set guide 43 may be moved to the third position by a driving force from one of the motor M1, the motor M2, and another driving source (not shown), without contacting the stopper 44. Further, when the controller determines that the particular sensor (not shown) has detected that the stopper 44 has moved to the second position, the set guide 43 may be moved to the fourth position by the driving force from one of the motor M1, the motor M2, and the other driving source (not shown), without contacting the stopper 44.

What is claimed is:

1. A sheet feeder comprising:

a housing;

a supporter attached to the housing, the supporter having a particular surface;

a pickup roller rotatable around a pickup roller axis, a part of a surface of the pickup roller being exposed from the particular surface;

a stopper movable between a first position and a second position, a distal end of the stopper being configured to, when the stopper is in the first position, be closer to the pickup roller axis than the part of the surface of the pickup roller, the distal end of the stopper being further configured to, when the stopper is in the second position, be farther from the pickup roller axis than the part of the surface of the pickup roller;

a driving mechanism configured to move the stopper between the first position and the second position, the driving mechanism comprising a motor; and a set guide movable between a third position and a fourth position, the set guide having a first surface that faces in a particular direction such as to become farther away from the part of the surface of the pickup roller, the first surface being configured to, when the set guide is in the third position and in contact with the stopper in the first position, be farther from the pickup roller axis than all the surface of the pickup roller, the first surface being further configured to, when the set guide is in the fourth position and separated away from the stopper in the second position, be closer to the pickup roller axis than the part of the surface of the pickup roller;

wherein the set guide is rotatable around a first rotational axis along the pickup roller axis, the first rotational axis being positioned at a middle portion of the set guide in the sheet feeding direction, and wherein the stopper is configured to contact an end portion of the set guide in the sheet feeding direction.

2. The sheet feeder according to claim 1, wherein the set guide comprises:

a first member rotatable around the first rotational axis; and a second member rotatable around a second rotational axis along the pickup roller axis, the second member having the first surface, and wherein, in response to the stopper being placed in the first position by the driving mechanism and brought into contact with the first member, the set guide is placed in the third position where the first surface of the second member is positioned downstream of all the surface of the pickup roller in the particular direction, and wherein, in response to the stopper being placed in the second position by the driving mechanism and separated away from the first member, the first member is separated away from the second member, and the set guide is placed in the fourth position where the first surface of the second member is positioned upstream of the part of the surface of the pickup roller in the particular direction.

3. The sheet feeder according to claim 2, wherein the first member has:

a first end portion positioned downstream of the first rotational axis in the sheet feeding direction; and a second end portion positioned upstream of the first rotational axis in the sheet feeding direction, and wherein the stopper is in contact with the first end portion when the stopper is in the first position, and wherein the stopper is separated away from the first end portion when the stopper is in the second position.

4. The sheet feeder according to claim 3, wherein the second rotational axis is positioned upstream of the second end portion of the second member in the sheet feeding direction.

5. The sheet feeder according to claim 2, wherein the second end portion of the first member is further configured to contact a lower surface of the second member.

6. The sheet feeder according to claim 2, wherein the second member of the set guide comprises:

a first section having the first surface; and a second section extending in a direction intersecting the first surface, the second section being configured to connect the first surface with the second rotational axis, and wherein the second section is configured to, when the set guide is in the third position, be separated away from the first member.

7. The sheet feeder according to claim 6, wherein the first section of the second member is configured to, when the set guide is in the third position, extend in a direction between a vertically downward direction and a horizontal direction, from a contact position where the second member contacts the second end portion of the first member.

8. The sheet feeder according to claim 2, wherein a distance between the first rotational axis and the first end portion of the first member is equal to or more than a distance between the first rotational axis and the second end portion of the first member.

9. The sheet feeder according to claim 1, wherein the stopper has a second surface facing in a direction opposite to the sheet feeding direction, wherein the stopper is rotatable around a third rotational axis along the pickup roller axis, between the first position and the second position, and wherein a trajectory of the second surface when the stopper rotates between the first position and the second position is positioned downstream, in the sheet feeding direction, of the second surface of the stopper in the first position.

10. The sheet feeder according to claim 1, wherein the pickup roller comprises a first roller and a second roller, the first roller and the second roller being disposed apart from each other along the pickup roller axis, and wherein the stopper comprises:

a first stopper opposed to the second roller with respect to the first roller in a direction along the pickup roller axis;

a second stopper opposed to the first roller with respect to the second roller in the direction along the pickup roller axis; and a third stopper disposed between the first roller and the second roller in the direction along the pickup roller axis.

11. The sheet feeder according to claim 1, wherein the set guide comprises:

a first set guide disposed farther from a second end of the pickup roller in a direction along the pickup roller axis than a first end of the pickup roller in the direction along the pickup roller axis; and a second set guide disposed farther from the first end of the pickup roller in the direction along the pickup roller axis than the second end of the pickup roller in the direction along the pickup roller axis, and wherein the first set guide and the second set guide are attached to a shaft along the pickup roller axis.

12. The sheet feeder according to claim 1, wherein the motor is configured to drive a retard roller, the retard roller being disposed to face the pickup roller; and wherein the driving mechanism further comprises a transmission mechanism configured to transmit a driving force from the motor to the stopper.

13. The sheet feeder according to claim 12, wherein the driving mechanism further comprises a spring configured to urge the stopper toward the second position.

14. A sheet feeder comprising:

a feed tray configured to support a sheet placed thereon;

a pickup roller configured to rotate around a pickup roller axis and feed the sheet placed on the feed tray in a sheet feeding direction;

a stopper movable between:

a restriction position where the stopper restricts the sheet from being fed downstream in the sheet feeding direction by the pickup roller; and a permission position where the stopper permits the sheet to be fed downstream in the sheet feeding direction by the pickup roller;

a driving mechanism configured to move the stopper between the restriction position and the permission position, the driving mechanism comprising a motor; and a set guide movable between:

a contact position to allow the pickup roller to contact the sheet placed on the feed tray; and a non-contact position to prevent the pickup roller to contact the sheet placed on the feed tray, wherein the set guide is configured to, in response to the stopper being placed in the restriction position by the driving mechanism, come into contact with the stopper and move to the non-contact position, wherein the set guide is further configured to, in response to the stopper being placed in the permission position by the driving mechanism, be separated away from the stopper and move to the non-contact position;

wherein the stopper has a second surface facing in a direction opposite to the sheet feeding direction, wherein the stopper is rotatable around a third rotational axis along the pickup roller axis, between the first position and the second position, and wherein a trajectory of the second surface when the stopper rotates between the first position and the second position is positioned downstream, in the sheet feeding direction, of the second surface of the stopper in the first position.

15. A sheet feeder comprising:

a feed tray configured to support a sheet placed thereon;

a pickup roller configured to rotate around a pickup roller axis and feed the sheet placed on the feed tray in a sheet feeding direction along a conveyance path;

a stopper movable between:

a restriction position where the stopper interrupts the conveyance path; and a permission position where the stopper does not interrupt the conveyance path;

a driving mechanism configured to move the stopper between the restriction first position and the permission position, the driving mechanism comprising a motor; and a set guide having a first surface facing in a particular direction such as to become farther away from a surface of the pickup roller, the set guide including:

a first set guide disposed farther from a second end of the pickup roller in a direction along the pickup roller axis than a first end of the pickup roller in the direction along the pickup roller axis; and a second set guide disposed farther from the first end of the pickup roller in the direction along the pickup roller axis than the second end of the pickup roller in the direction along the pickup roller axis, and wherein the first set guide and the second set guide are attached to a shaft along the pickup roller axis, the set guide being movable between:

a third position where the first surface is positioned downstream of all the surface of the pickup roller in the particular direction; and a fourth position where the first surface is positioned upstream of at least a part of the surface of the pickup roller in the particular direction, wherein, in response to the stopper being placed in the restriction position by the driving mechanism, the stopper comes into contact with the set guide, and the set guide is placed in the third position, and wherein, in response to the stopper being placed in the permission position by the driving mechanism, the stopper is separated away from the set guide, and the set guide is placed in the fourth position.

* * * * *